US012584322B2

(12) United States Patent
Smith

(10) Patent No.: US 12,584,322 B2
(45) Date of Patent: Mar. 24, 2026

(54) FOLDING UTILITY SCAFFOLD

(71) Applicant: ScaffoldMart, Greenville, NC (US)

(72) Inventor: Grady F. Smith, Greenville, NC (US)

(73) Assignee: GRADY F. SMITH & CO., INC., Greenville, NC (US)

( * ) Notice: Subject to any disclaimer, the term of this patent is extended or adjusted under 35 U.S.C. 154(b) by 525 days.

(21) Appl. No.: 18/096,950

(22) Filed: Jan. 13, 2023

(65) Prior Publication Data

US 2023/0235580 A1 Jul. 27, 2023

Related U.S. Application Data

(60) Provisional application No. 63/301,659, filed on Jan. 21, 2022.

(51) Int. Cl.

| | |
|---|---|
| ***E04G 1/30*** | (2006.01) |
| ***E04G 1/17*** | (2006.01) |
| ***E04G 5/14*** | (2006.01) |
| *E04G 1/24* | (2006.01) |

(52) U.S. Cl.

CPC ..... *E04G 1/30* (2013.01); *E04G 1/17* (2013.01); *E04G 5/142* (2013.01); *E04G 2001/242* (2013.01); *E04G 2001/305* (2013.01)

(58) Field of Classification Search

CPC .. E04G 1/34; E04G 5/003; E04G 5/08; E04G 5/004; E04G 1/30; E04G 2001/305; E04G 5/02

See application file for complete search history.

(56) References Cited

U.S. PATENT DOCUMENTS 2,619,390 A * 11/1952 Johnson ..... E04G 1/154 182/119
3,028,928 A * 4/1962 Jucuiano ..... E04G 1/18 182/178.1
3,212,605 A * 10/1965 Dickerson ..... E04G 1/34 182/119
4,534,447 A * 8/1985 Champigny ..... E04G 1/34 182/119
4,632,222 A * 12/1986 Chen ..... E04G 7/26 248/220.22

(Continued)

*Primary Examiner* — Christopher D Hutchens
(74) *Attorney, Agent, or Firm* — COATS & BENNETT, PLLC

(57) ABSTRACT

The claimed invention relates to a folding utility scaffold that greatly reduces the space requirement for shipment when the utility scaffold is in the folded configuration while maintaining or increasing stability. The scaffold includes first and second ladder frames and a hinge assembly interconnecting the ladder frames. The scaffold comprises first and second ladder frames and a hinge assembly interconnecting the ladder frames. The hinge assembly enables movement of the scaffold between an unfolded configuration in which the ladder frames are spaced apart and a folded configuration in which the ladder frames are disposed side by side, i.e., with the ladder frames touching. The ladder frame and hinge assembly are designed to avoid interference between components of the hinge assembly and components of the ladder frame in the folded configuration so that the ladder frames can be disposed in side-by-side relation in the folded configuration.

18 Claims, 11 Drawing Sheets

(56) References Cited

U.S. PATENT DOCUMENTS

| | | | | |
|---|---|---|---|---|
| 5,086,875 | A * | 2/1992 | Shreve, III | E04G 1/34 182/119 |
| 5,099,953 | A * | 3/1992 | Stegath | E04G 1/34 182/230 |
| 5,158,023 | A * | 10/1992 | Allen | E04G 5/00 182/120 |
| 5,555,954 | A * | 9/1996 | Swiderski | E04G 1/34 182/119 |
| 6,932,194 | B1 * | 8/2005 | Chipman | E04G 1/28 182/112 |
| 7,353,911 | B1 * | 4/2008 | Freeman | E04G 5/06 248/238 |
| 8,210,312 | B1 * | 7/2012 | Tetreault, Jr. | E04G 1/34 182/119 |
| 2008/0000722 | A1 * | 1/2008 | Winslow | E04G 5/003 182/129 |

* cited by examiner

FOLDING UTILITY SCAFFOLD

RELATED APPLICATIONS

The present application claims benefit of U.S. Provisional Application No. 63/301,659, filed on Jan. 21, 2022, the disclosure of which is incorporated herein by reference in its entirety.

TECHNICAL FIELD

The present disclosure relates generally to scaffolding and, more particularly to a folding utility scaffold.

BACKGROUND

Folding utility scaffolds are known that collapse into a compact form for storage and shipment. A folding scaffold typically comprises first and second ladder frames with a hinge assembly interconnecting the ladder frames. The hinge assembly enables movement of the scaffold between an unfolded configuration for use and a folded configuration for storage and shipment. Given the rising cost of shipment, there is great interest is designing products generally, and scaffolds in particular, to be more compact in order to reduce shipping costs.

SUMMARY

The claimed invention relates to a folding utility scaffold that greatly reduces the space requirement for shipment when the utility scaffold is in the folded configuration. A problem with existing utility scaffolds is that interference between components of the hinge assembly and components of the ladder frame limit the degree to which the scaffold can be collapsed. In embodiments of the present disclosure, the ladder frame and hinge assembly are designed to avoid interference between the components of the hinge assembly and the components of the ladder frame in the folded configuration.

According to an embodiment, the scaffold comprises first and second ladder frames and a hinge assembly interconnecting the ladder frames. The hinge assembly enables movement of the scaffold between an unfolded configuration in which the ladder frames are spaced apart and a folded configuration in which the ladder frames are disposed side by side, i.e., with the ladder frames touching. The ladder frame and hinge assembly are designed to avoid interference between the components of the hinge assembly and the components of the ladder frame in the folded configuration so that the ladder frames can be disposed in side-by-side relation in the folded configuration.

DETAILED DESCRIPTION

Figure 1:
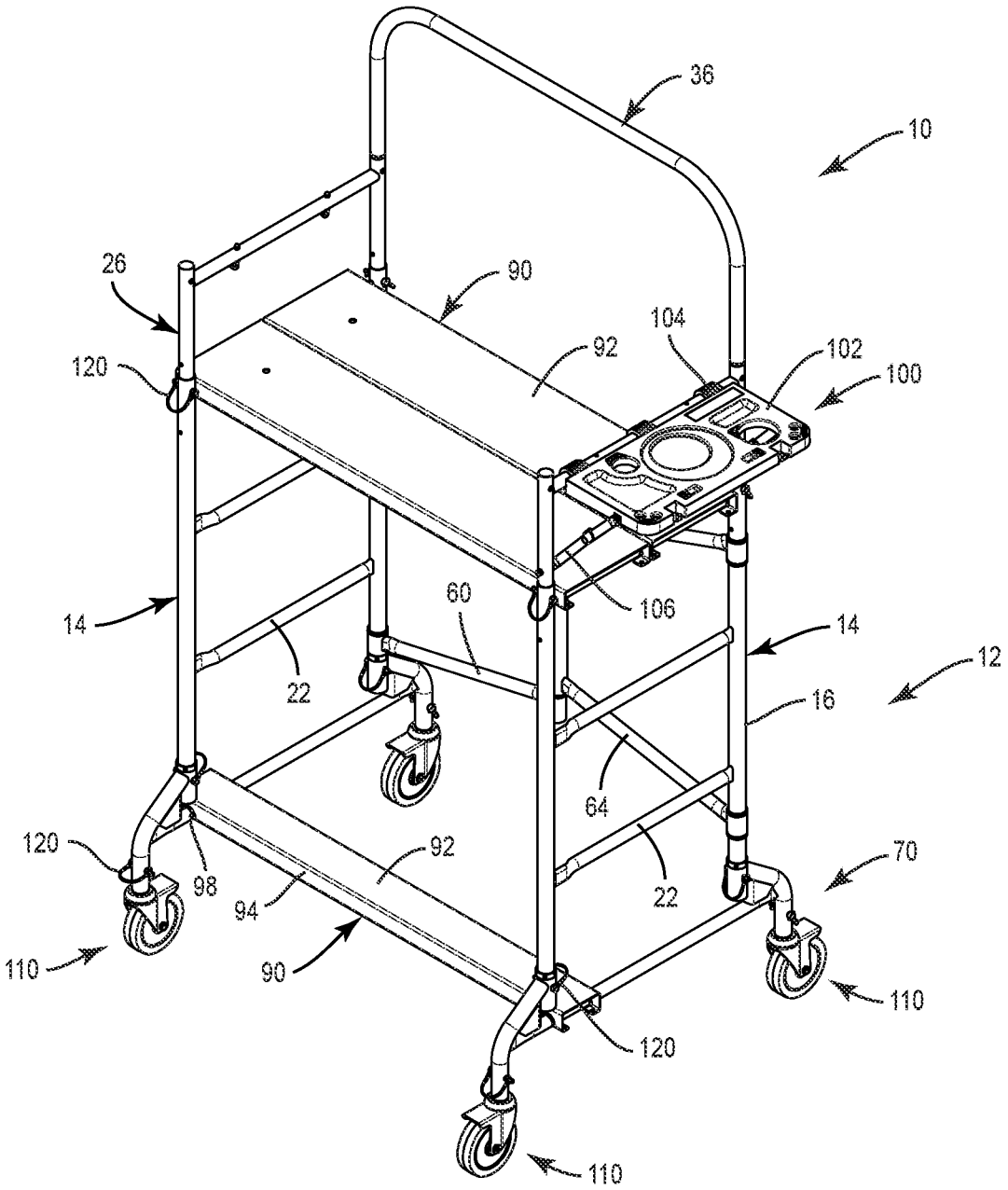
FIG. 1 is a perspective view of the folding utility scaffold with the ladder extensions in a retracted position.
Figure 2:
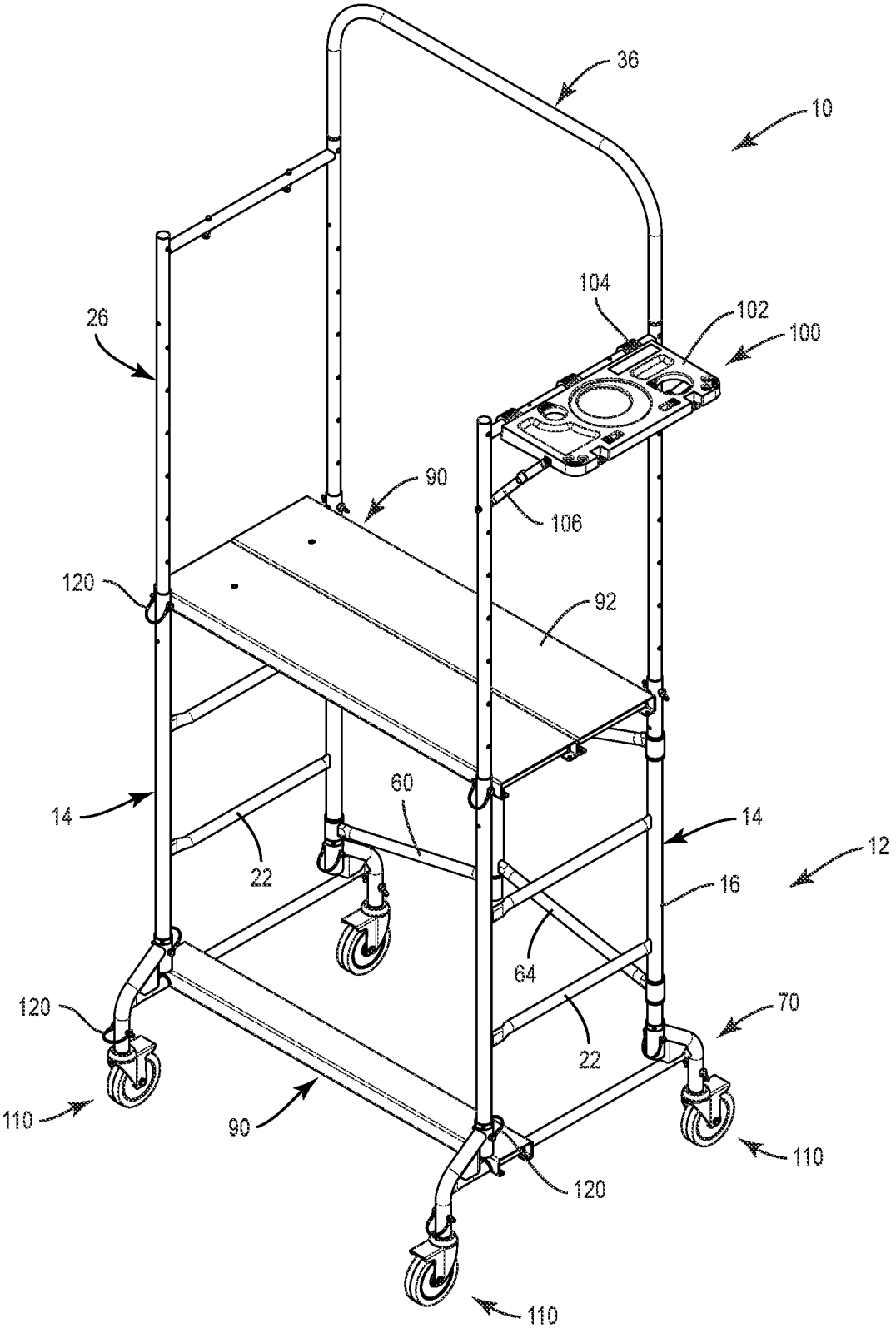
FIG. 2 is a perspective view of the folding utility scaffold with the ladder extensions in an extended position.

Referring now to the drawings, FIGS. 1 and 2 illustrate one example of the folding utility scaffold, which is indicated generally by the numeral 10. The utility scaffold 10 is designed to be broken down and collapsed for more compact packaging. The utility scaffold 10 generally comprises a main frame 12, two base assemblies 70 and a set of walkboards 90 of various widths. The main frame 12 is designed to fold into a compact form for shipment and storage. The base assemblies 70 are removable and are designed to fit inside the walkboards 90 when the scaffold 10 is disassembled. The components of the scaffold 10 are designed to fit together so as to occupy as small a space as possible for packaging and shipment. The reduction in packaging size results in much lower costs for shipping and storage.

The main frame 12 of the utility scaffold 10 comprises two ladder frames 14, two ladder extensions 16, a spreader bar 36 and a hinge assembly 50. The ladder extensions 26 are inserted into the top end of respective ladder frames 14 and are movable between retracted and extended positions as shown in FIGS. 1 and 2, respectively. The hinge assembly 50 extends between and interconnects the ladder frames 14. The hinge assembly 50 enables the folding of the main frame 12 as hereinafter described. The spreader bar 36 extends between and connects the ladder extensions 34 to prevent the main frame 12 from folding during use and provide a safety rail for a worker standing on the scaffold 10.

Figure 3:
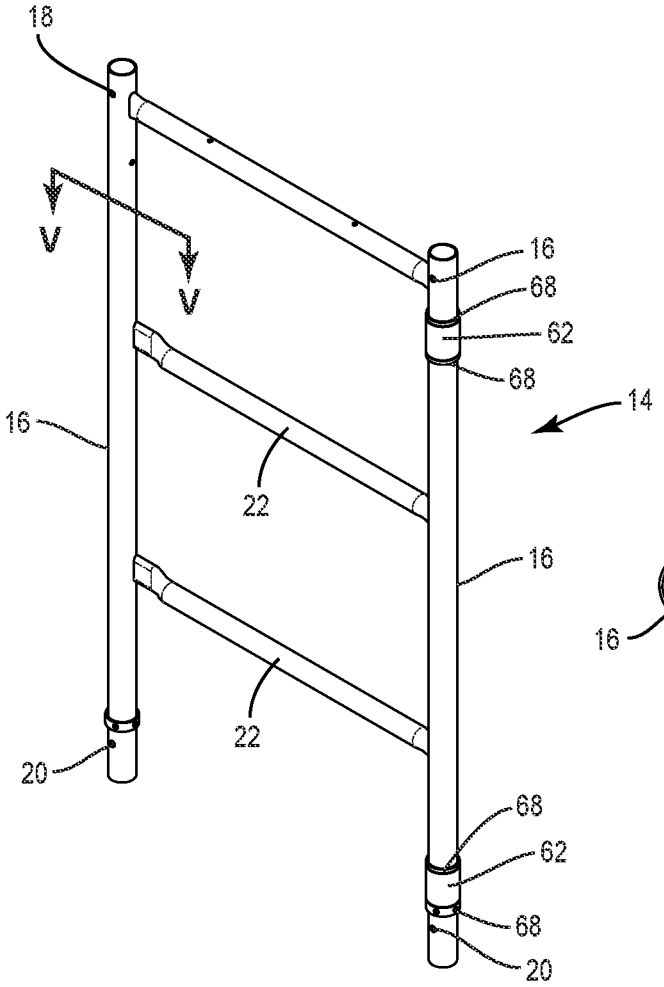
FIG. 3 is a perspective view of a ladder frame for the main frame.
Figure 5:
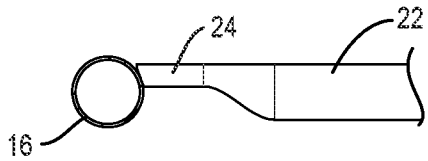
FIG. 5 is a top view showing the crimped end for the ladder rung connected to a vertical support of the ladder frame.
Figure 4A:
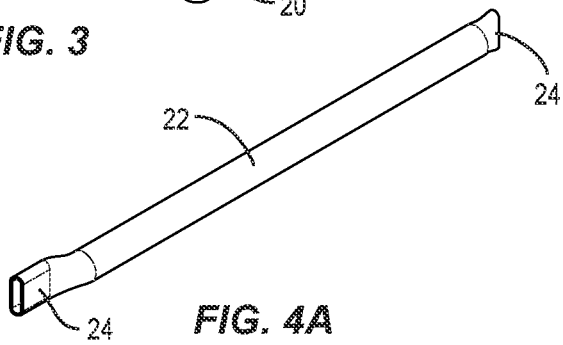
FIGS. 4A, 4B and 4C are a perspective view, top view and elevation view respectively of a ladder rung for the ladder frame.
Figure 4B:
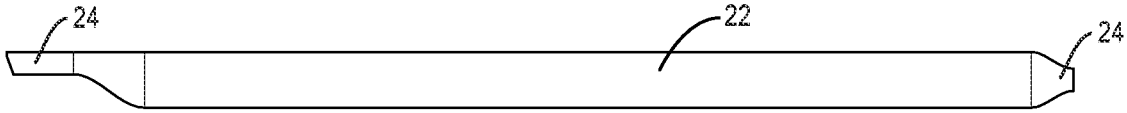
Figure 4C:
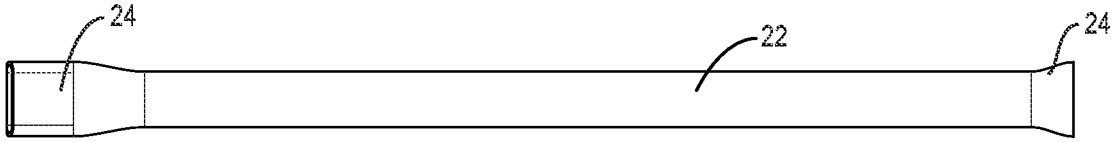

FIG. 3 illustrates an exemplary ladder frame 14. Each ladder frame 14 comprises two vertical supports 16 interconnected by a plurality of ladder rungs 22 welded to the vertical supports 16. In this example, the ladder frame 14 comprises three ladder rungs 22. A top opening 18 is formed near an upper end of each vertical support 16 and a bottom opening 20 is formed near a lower end of each vertical support 16. The ends of the ladder rungs 22 are crimped to form vertically-oriented tongues 24 for a more robust weldment to the vertical supports 16. Generally, the crimped ends of the ladder rungs 18 form tongues 24 that align with a longitudinal axis of the ladder rung 22. However, for selected ones of the ladder rungs 22, one end is crimped to form an offset 24 as shown in FIGS. 4A-4C. In this example, the first and second ladder rungs 22 from the bottom have an offset tongue 24 at one end. As will be hereinafter described in more detail, the offset tongue 24 is designed to provide clearance between the ladder rungs 22 for more compact packaging. FIG. 5 is a section view taken through line V-V of FIG. 3 showing how the offset tongue 24 connects to the vertical support 16.

Figure 6:
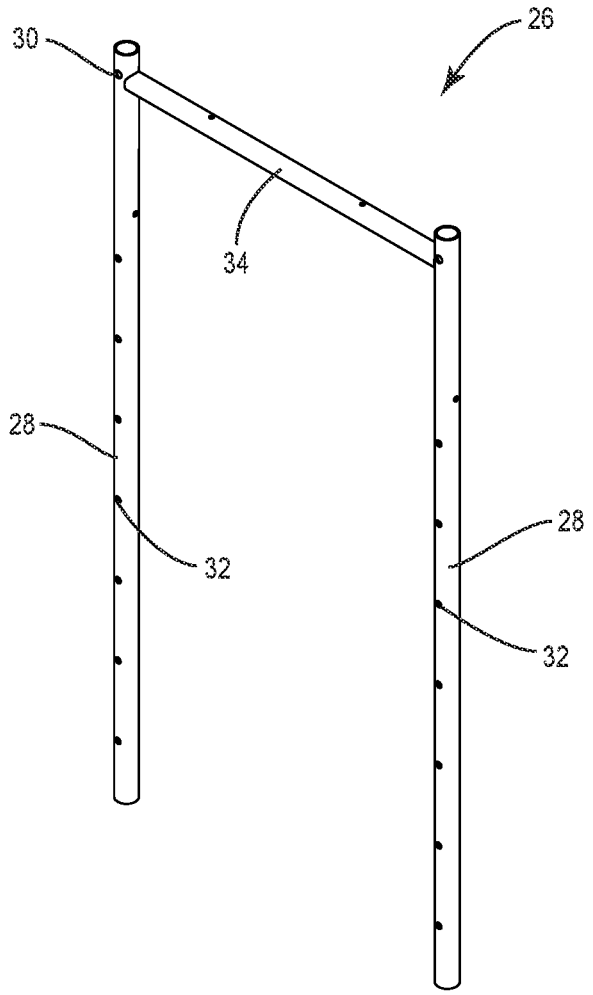
FIG. 6 is a perspective view of the ladder extension for the main frame.

FIG. 6 illustrates an exemplary ladder extension 26. Each ladder extension 26 comprises two vertical extension members 28 designed to fit into the upper ends of the vertical supports 16 of the ladder frame 14 and a ladder rung 34 connected between the extension members 28. Each extension member 28 includes an opening 30 near a top end of the extension member 28 and a series of openings 32 that align with the top opening 18 in a respective one of the vertical supports 16.

The extension members 28 are able slide up and down in the respective vertical supports 16 in a telescoping manner to adjust a height of the ladder extension 26 and spreader bar 42. The ladder extensions are adjustable between a minimum height (shown in FIG. 1) and a maximum height (shown in FIG. 2) in the folded configuration. The minimum height is the lowest height designed for use and the maximum height is the greatest height designed for use. When the ladder extension 16 is adjusted to a desired height, span pins 120 can be inserted through the openings 20 at the tops ends of the vertical supports 16 and through the aligned openings 32 in the extension members 28 to secure the ladder extension 16 at the desired height.

According to one aspect of the disclosure, the ladder extensions 26 can be retracted in the folded configuration so that the overall length in the folded configuration is less than the length in an unfolded configuration. That is, the overall length of the ladder frames 14 with the ladder extensions 26 is less in the folded configuration than a minimum length in the unfolded configuration. Reducing the length of the ladder frames 14 with the extensions 26 reduces the package length for shipping and thus reduces shipping costs.

Figure 7:
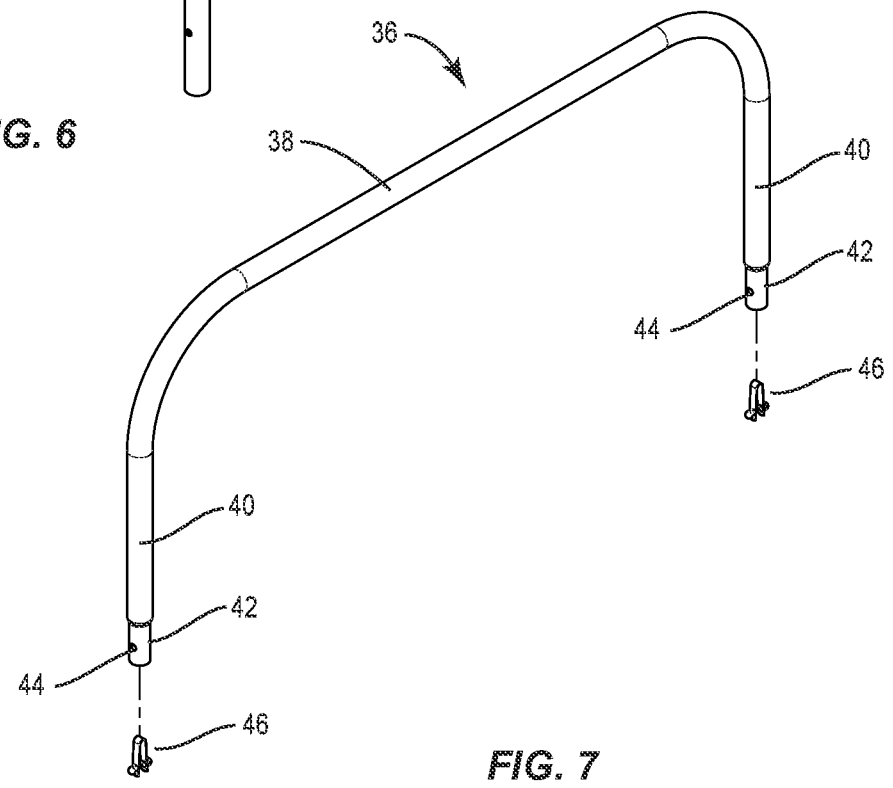
FIG. 7 is a perspective view of the spreader bar for the main frame

FIG. 7 illustrates an exemplary spreader bar 36 that is designed to connect between the extension members 28 when the main frame 12 is in the unfolded configuration as shown in FIGS. 1 and 2. The spreader bar 36 comprises a single length of tube with a top rail 38 and two legs 40 extending downward from respective ends of the top rail 38. The outer diameter of the legs 40 is the same as the outer diameter of the extension members 28. Each leg 40 includes a reduced diameter section 42 to fits into the upper end of a respective extension member 28. The reduced diameter section 42 includes an opening 44 that aligns with the opening 30 in the top end of a respective extension member 28. A quick release button 46 fits into the end of the legs 46 and projects through the opening 44. When the spreader bar 36 is connected to the ladder extension 26, the quick release buttons 46 engage with the top opening 30 in the extension members 28.

When a worker is standing on the walkboards 90 spanning between the ladder frames 14, the ladder extension 26 and spreader bar 42 provide a safety rail to prevent the worker from falling off the scaffold 10. The height of the "safety rail" can be adjusted by extending and retracting the ladder extensions as previously described.

As shown in FIGS. 1 and 2, a tool shelf 100 is rotatably mounted to the ladder rung 34 on one of the ladder extensions 26. The tool shelf 100 comprises a tray 102 with clips 104 along the rear edge of the tray 102 for mounting the tool shelf 100 to the ladder rung 34 of the ladder extension 26. The clips 104 are designed to frictionally engage the ladder rung 34 of the extension member 26 while allowing for rotation of the tray 100 about the ladder rung 34. Folding braces 106 connect between the tray 102 and respective extension members 28 of the ladder extension 26 to support the tool shelf 100 in a deployed position as shown in FIGS. 1 and 2. When the tool shelf 100 is not needed or not in use, the tool shelf 100 can be folded down against the ladder extension 26/ladder frame 14. Because the tool shelf 100 is mounted to the ladder extension 26, the tool shelf 100 is also raised and lowered with the ladder extension 26 so that a worker standing on the walkboards 90 can more easily access their tools.

Figure 8A:
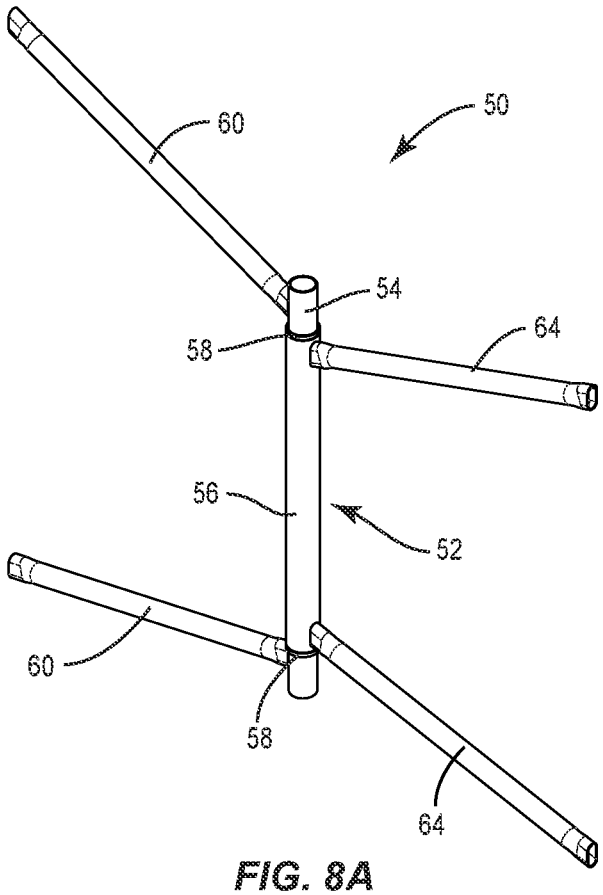
FIG. 8A is a perspective view of the hinge assembly for the main frame.
Figure 8B:
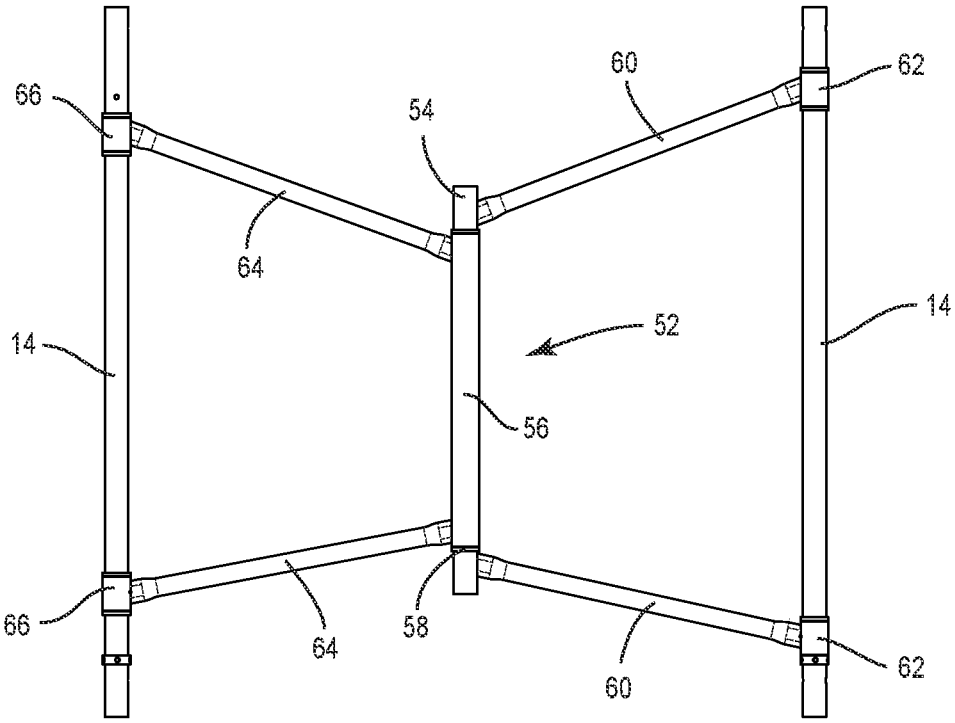
FIG. 8B is an elevation view of the hinge assembly.

FIGS. 8A and 8B illustrate the hinge assembly 50 for the main frame 12. The hinge assembly 50 includes a central hinge 52, first cross braces 60 and second cross braces 64. The hinge assembly 50 is designed to provide greater stability than prior art designs while also allowing the scaffold 10 to fold into a compact form.

The hinge 52 comprises an inner hinge part (or first hinge part) 54 and an outer hinge part (or second hinge part) 56. Both the inner hinge part 54 and outer hinge part 56 comprise metal tubes in this embodiment. The inner hinge part 54 is designed to be rotatably received in the outer hinge part 56 and secured by hinge retainers 58 welded to the inner hinge part 54. The inner hinge part 54 is longer than the outer hinge part and projects from both ends of the outer hinge part 56.

Though shown as a single piece in FIGS. 8A and 8B, the outer hinge part 56 could comprise two separate sleeves to which the cross braces 64 are attached. Therefore, the illustrated embodiment should be taken as only one example of how the hinge assembly 50 can be constructed.

The first cross braces 60 connect the inner hinge part 54 to a vertical support 16 on a first one of the ladder frames 14 and the second cross braces connect the outer hinge part 56 to a vertical support 16 on a second one of the ladder frames 14. The first cross braces 60 include sleeves 62 that are rotatably journaled on the vertical support 16 of the first ladder frame 14. The second cross braces 64 include sleeves 66 that are rotatably journaled on the vertical support 16 of the first ladder frame 14. The sleeves 62, 66 are secured to the vertical supports 16 of the respective ladder frames 14 by sleeve retainers 68 welded to the vertical supports 16. The location along the length of the vertical supports 16 where the cross braces 60, 64 connect are referred to herein as the connection points.

In conventional utility scaffolds, the cross braces 60, 64 extend horizontally with respect to the ground, i.e., perpendicular to the vertical supports 16, so that the cross braces 60, 64 do not cross the ladder rungs 22 and create interference when the scaffold 10 is collapsed. According to one aspect of the disclosure, the cross braces 60, 64 are angled to increase the distance between the connection points along each vertical support 16 and provide greater stability to the main frame 12 in the unfolded configuration. The location of the connection points are selected so that the cross braces 60, 64 do not cross or interference with the ladder rungs 22 in the folded configuration. In one embodiment, the connection points for a cross brace with the first and second ladder rungs fall within the same segment of the ladder frames as defined by the ladder rungs. In an alternative embodiment (not shown), the ladder rungs 22 and cross braces 60, 64 could be allowed to cross. In order to avoid interference in this case, the ladder rungs 22 and cross braces 60 are crimped at the crossing point so that they do not interfere in the folded configuration.

Figure 9:
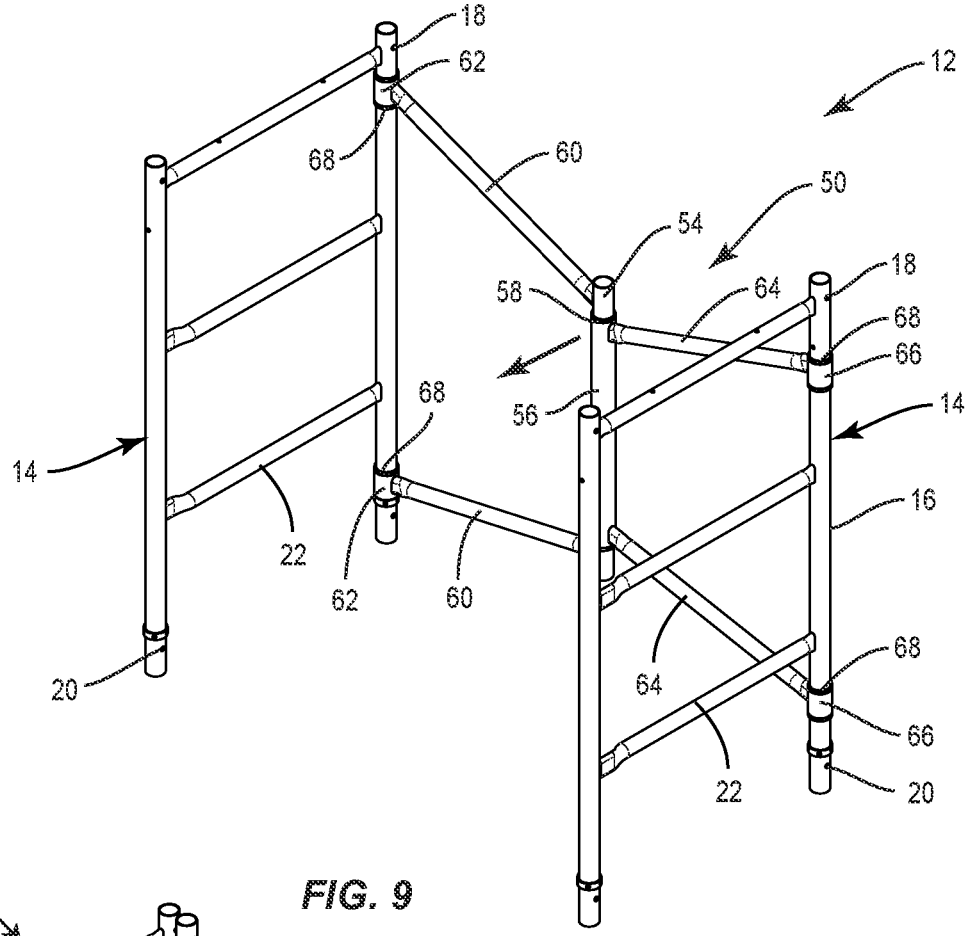
FIG. 9 is a perspective view of the main frame for the scaffold in an unfolded configuration for use.
Figure 10:
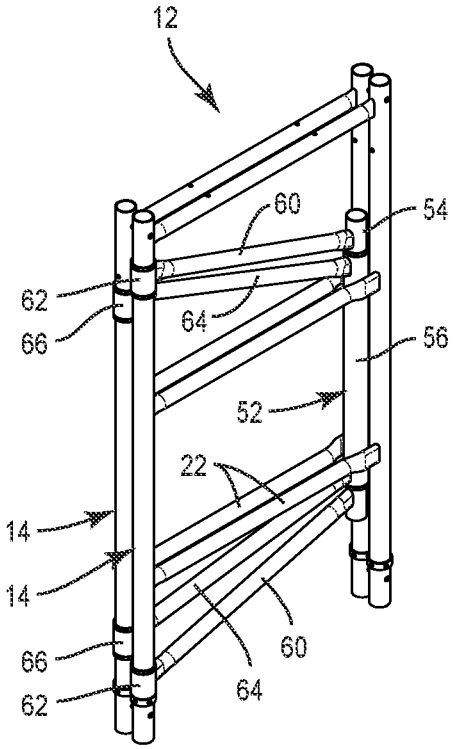
FIG. 10 is a perspective view of the main frame for the scaffold in a folded configuration for storage or shipment.

The hinge assembly 50 enables the folding of the main frame 12 for storage and/or shipment. FIGS. 9 and 10 illustrate the ladder frames 14 and hinge assembly 50 in unfolded and folded configurations, respectively. When the main frame 12 is collapsed for shipment or storage, the spreader bar 42 is removed. The hinge 52 folds inward as the two ladder frames 14 are moved together as indicated by the arrow in FIG. 9. FIG. 10 shows the main frame in the folded configuration.

To enable compact packaging, interference between components of the hinge assembly 50 and the components of the ladder frames 14 should be avoided so that the ladder frames 14 can be disposed side by side in the folded configuration. The interference reduction has two aspects. First, interference between the hinge 52 and ladder rungs 22 needs to be avoided so that the hinge 52 does not contact or collide with the ladder rungs 22 in the folded configuration. Second, interference between the cross braces 60, 64 and ladder rungs 22 needs to be avoided so that the cross braces 60, 64 not contact or collide with the ladder rungs 22 in the folded configuration. Elimination of interference between components of the main frame 12 enables the main frame 12 to be fully collapsed so that the ladder frames 14 make contact in the folded configuration and reduce the space required for storage and shipment.

As previously noted, the offset tongues 24 on the first and second ladder rungs 18 provides a clearance space between the ladder rungs 18. The hinge assembly 50 and clearance space are designed such that the hinge 52 can be received in the clearance space between the ladder rungs 18 in the folded configuration. Also, the length of the cross-braces 60, 64 is designed such that that hinge 52 is received in the clearance space in the folded configuration. This means that the spacing between the vertical supports 16 and the hinge 52 is slightly less than the spacing between the two vertical supports on the same ladder frame 14. This design provides two benefits—avoiding interference between the hinge 52 and the ladder rungs 18 and avoiding interference between the cross braces 60, 64 and vertical supports 16 of the ladder frames 14.

Additionally, as previously noted, the arrangement of the cross braces 60, 64 are designed to avoid interference with the ladder rungs 22 when the main frame 12 is folded. In the exemplary embodiment, the lower one of the first and second cross braces 60, 64 (referred to herein as the lower cross branches 60, 64) connect to respective vertical supports 16 below the first ladder rung 22. The lower cross braces 60, 64 also connect to the inner hinge part 54 and outer hinge part 56 respectively at a height below the first ladder rung 22 so that the lower cross braces 60, 64 do not cross or contact the first ladder rungs 22 when the main frame 12 is folded. Similarly, the upper one of the first and second cross braces 60, 64 connect to a respective vertical support 16 between the second and third ladder rungs 22. The upper cross braces 60, 64 also connect to the inner hinge part 54 and outer hinge part 56 respectively at a height between the second and third ladder rungs 22 so that the upper cross braces 60, 64 do not cross or contact the second ladder rung 18 when the main frame 12 is folded.

Figure 11:
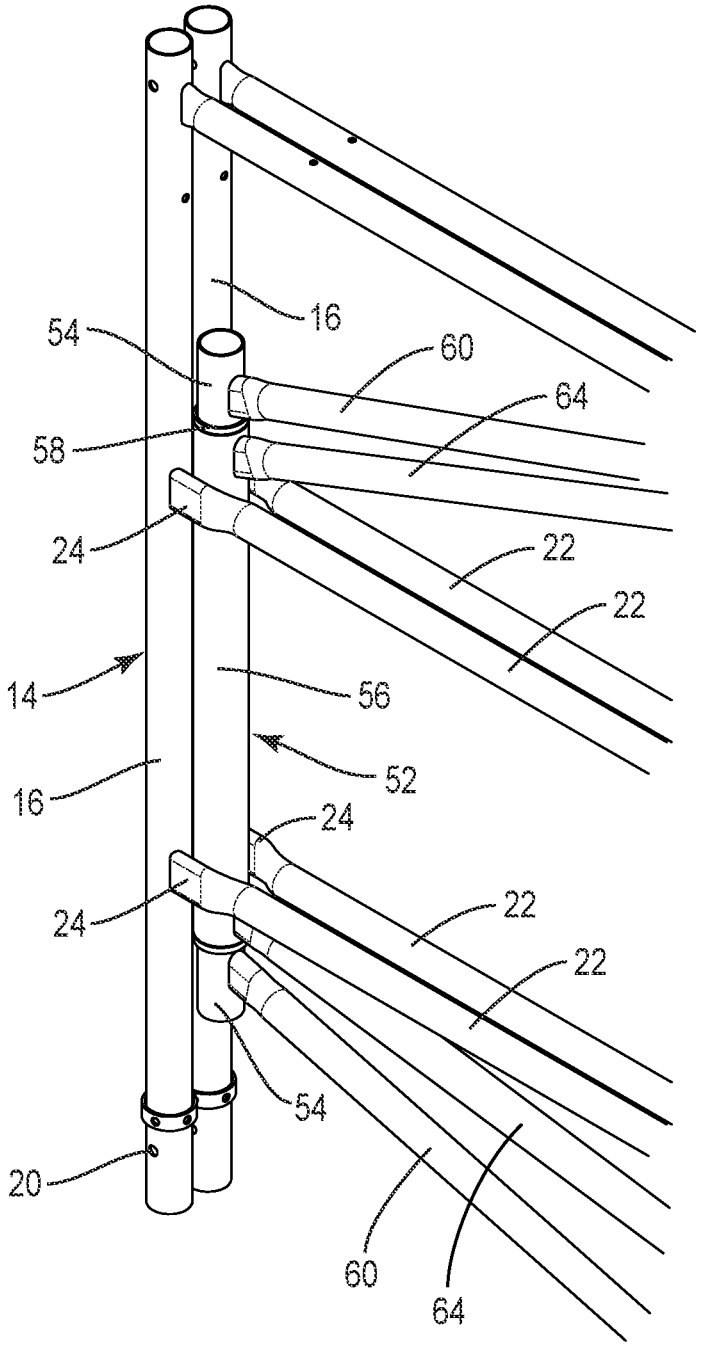
FIG. 11 is a detailed perspective of the main frame in a folded configuration.
Figure 12:
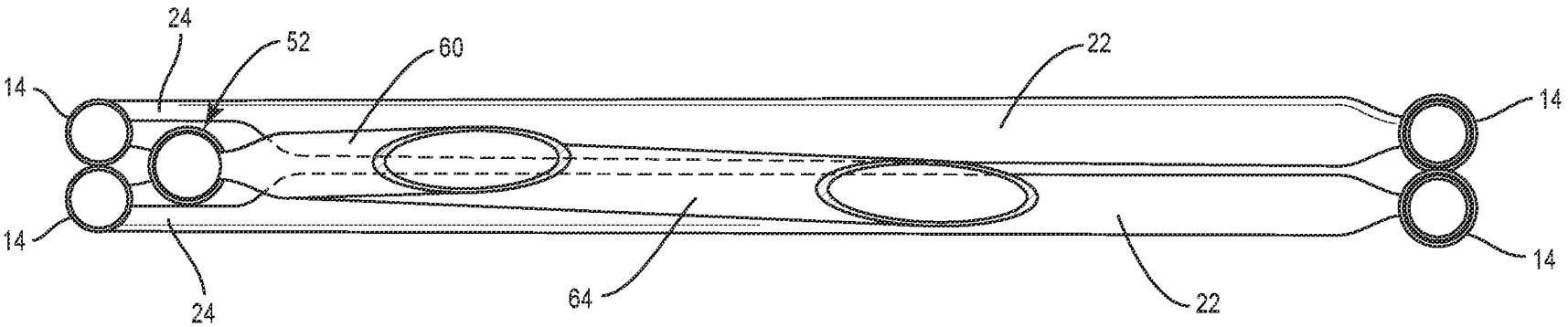
FIG. 12 is a section view of the main frame in a folded configuration.

FIGS. 11 and 12 illustrates the hinge 52 being received in the clearance space in the folded configuration. As seen in FIGS. 11 and 12, the offset tongues 24 form a space for the hinge 52 in the folded configuration so that interference between the hinge 52 and ladder rungs 22 does not prevent the ladder frames 14 from coming together. Also, if can be noted that the cross braces 60, 64 do not cross the ladder rungs 22.

Figure 13:
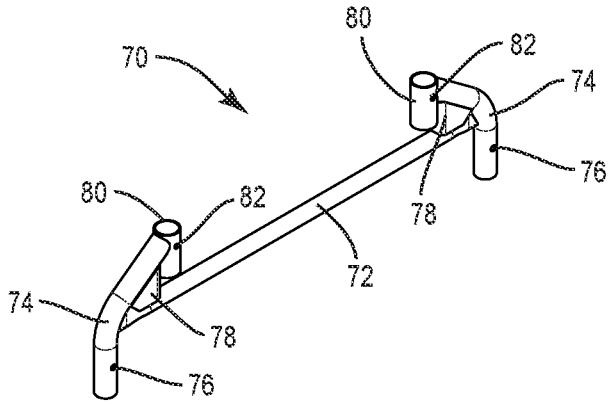
FIG. 13 is a perspective view of a base assembly for the folding scaffold.

FIG. 13 is a perspective view of a base assembly 70 for the folding scaffold 10. The base assembly 70 comprises a horizontal frame member 72 with an arcuate foot member 74 attached at each end thereof. A generally triangular shaped gusset 78 with a U-shaped cross section is connected between the horizontal frame member 72 and each foot member 74 to provide additional strength and rigidity. Each foot member 74 has a receiver 80 attached at the upper end thereof designed to receive the lower end of a respective vertical support 16 of one ladder frame 14. The receivers 80 are spaced such that a distance between the centers of the receivers 80 equals the distance between the centers of the vertical supports 16 of a ladder frame 14. Each receiver 80 includes an opening 82 formed therein that aligns with the bottom opening 20 of a respective vertical support 16.

In one embodiment, the overall length of the base assemblies 70 is greater the width of the ladder frames 14 to provide a wider base for the scaffold 10. Having a wider base allows the scaffold 10 to have a lower stability ratio and a greater standing height. The stability ratio is defined as the ratio of the standing height to the base width. A lower stability ratio provides greater safety during use. The base assemblies 70 in the illustrated embodiment provide an increase in the maximum standing height of the scaffold while reducing the stability ratio.

Figure 14:
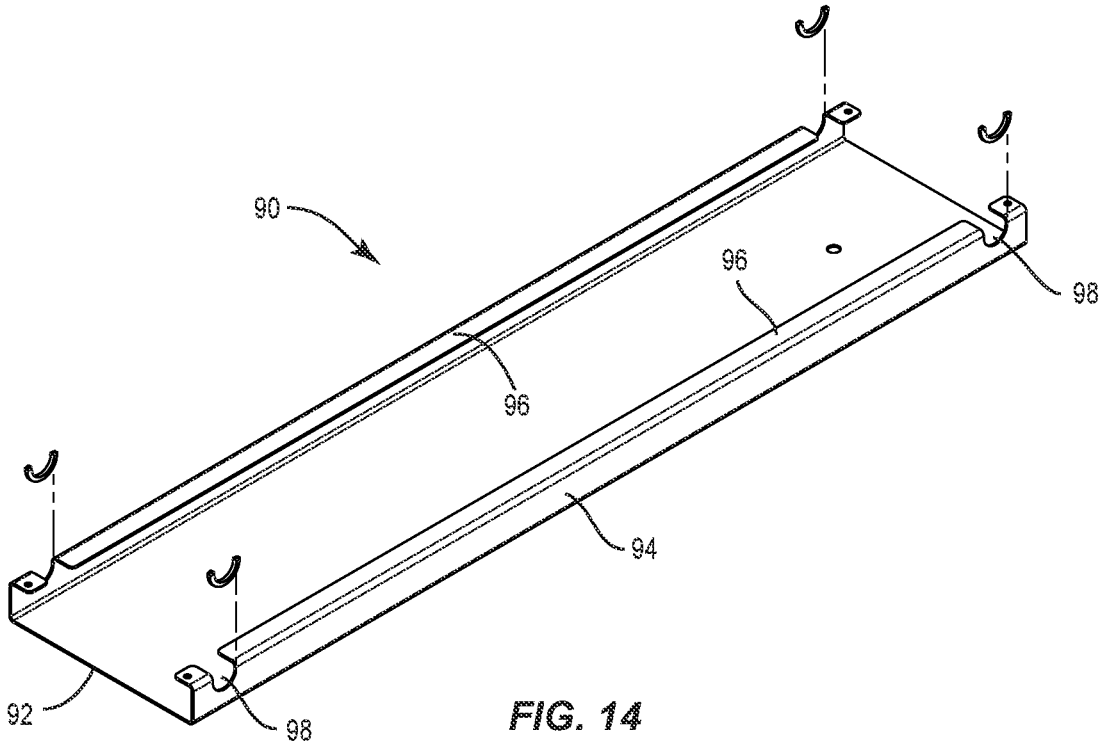
FIG. 14 is a perspective view of a walkboard for the scaffold.

FIG. 14 is a perspective view of an exemplary walkboard 90. The walkboard 90 is made of sheet metal that is formed into a walkboard 90. The walkboard 90 comprises a top surface 92, side walls 94, and flanges 96 that project inwardly from the sidewalls 94. Notches 98 are formed in the side walls to engage the ladder rungs 22 on the ladder frames 14. In use, the walkboards 90 are placed between ladder rungs 22 of the same height on the two ladder frames 14 as shown in FIGS. 1 and 2. Walkboards 90 of various widths can be provided. In the exemplary embodiment, three walkboards 90 are shown. The walkboards 90 are designed such that some of the components of the scaffold 10 can be inserted inside the walkboard 90 to facilitate more compact packaging.

According to an aspect of the present disclosure, the large walkboards 90 are designed to receive the base assemblies 70 when the components of the scaffold 10 are broken down for packaging. The overall height of the base assemblies 70 is less than a width of the walkboards 90 so that the base assemblies 70 fit insider the walkboards 90 for more compact packaging. This feature allows a greater length for the base assemblies 70 than conventional designs so that the maximum standing height can be increased while reducing the stability ratio.

Figure 15:
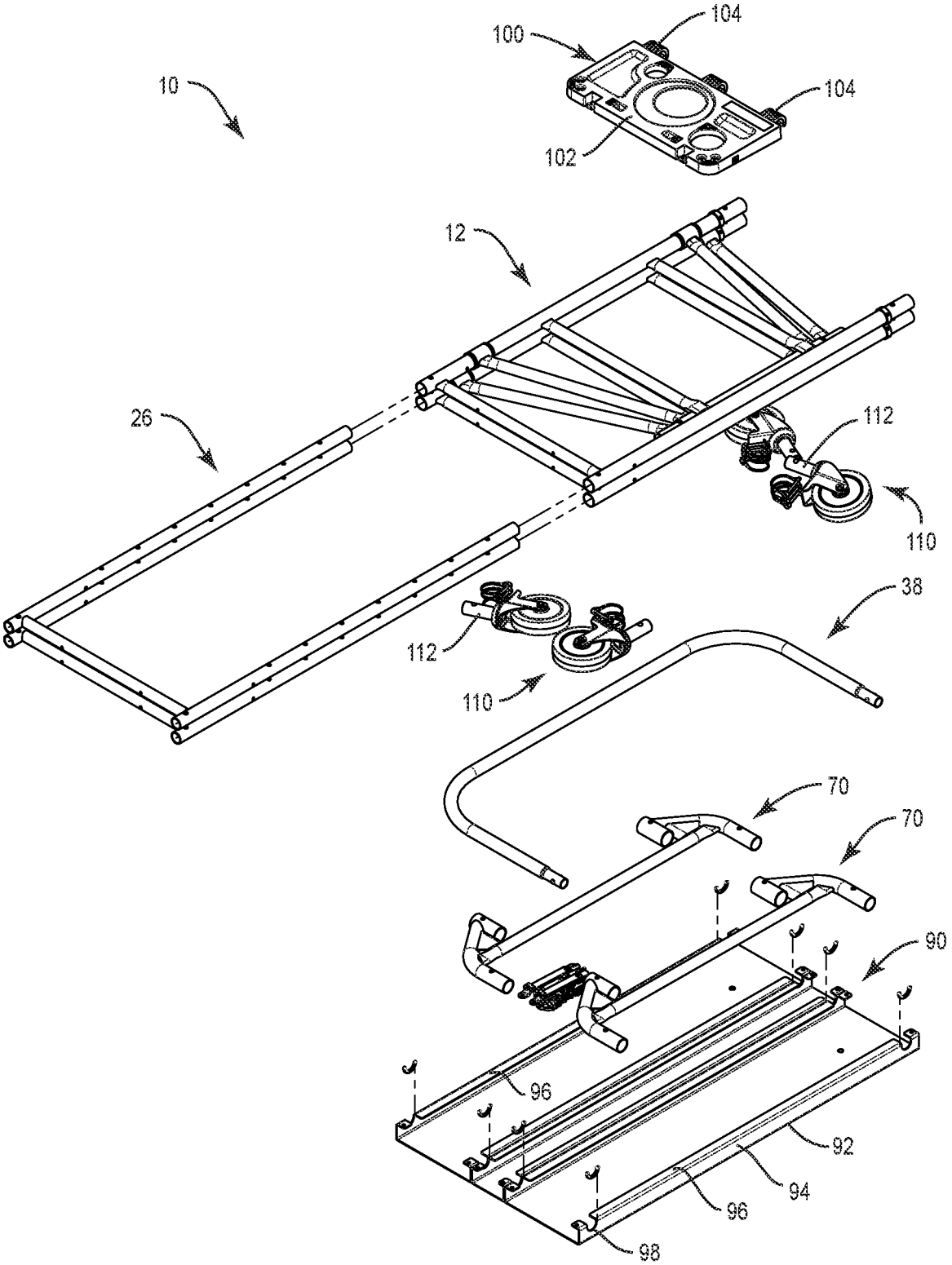
FIG. 15 is an exploded perspective view of the folded utility scaffold broken down for packaging.
Figure 16:
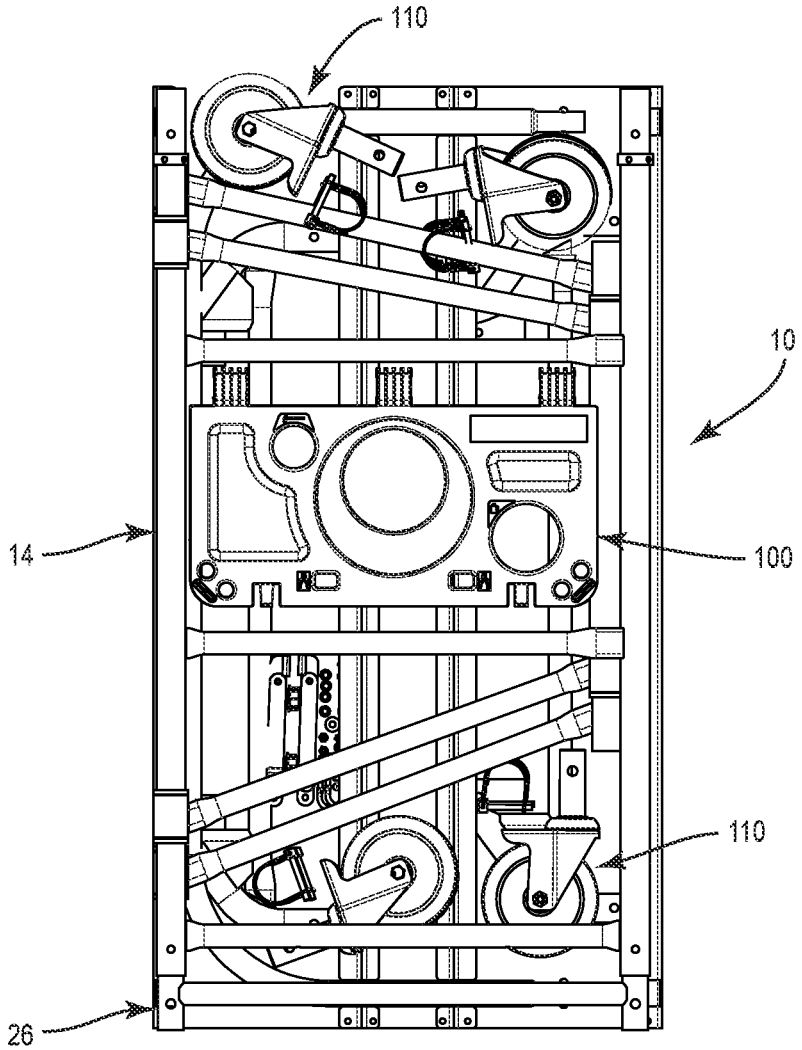
FIG. 16 is a plan view of the folding utility scaffold with the components broken down for packaging.

FIG. 15 is an exploded perspective view of the folding utility scaffold broken down for packaging. The walkboards 90 are arranged in side-by-side fashion with the bottom side facing up. The disassembled base assemblies 70 are placed inside the two larger walkboards 90 and the spreader bar 42 is placed on top. The legs 40 of the spreader bar 42 fit into the notches 98 on the walkboards to allow more compact packaging. The folded main frame 12 with the ladder extension in the retracted position are place on top of the walkboards 90. The tool shelf 100 and caster wheels 110 fare placed in the spaces between the ladder rungs 22 and cross braces 60, 64 as shown in FIG. 16.

Figure 17:
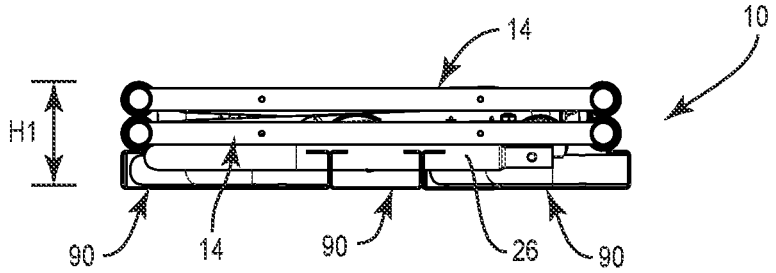
FIG. 17 is an end view of the folding utility scaffold with the components broken down for packaging.

The design of the scaffold 10 enables extremely compact packaging as shown in FIG. 17. FIG. 17 is an end view of the folding utility scaffold with the components broken down for packaging. As seen in FIG. 17, package height H1 is roughly equal to the height of the walkboard 90 and two ladder frames stacked on top of each other. In practical terms, this arrangement enables the components to fit into a package with a height less than 5 inches and more preferably less than 4.5 inches. The reduction in package size greatly reduces the cost of shipment where a prime determinant of cost is package size.

What is claimed is:

1. A folding scaffold movable between an unfolded configuration and a folded configuration, the folding scaffold comprising:

first and second ladder frames including an upper end and a lower end;

a hinge assembly interconnecting the first and second ladder frames, the hinge assembly comprising a hinge enabling movement of the scaffold between an unfolded configuration in which the ladder frames are spaced apart and a folded configuration in which the ladder frames are disposed side by side;

first and second removable walkboards extending between respective ladder rungs on the first and second ladder frames; and first and second base assemblies removably connected to the lower end of the first and second ladder frames respectively, wherein:

a length of the first and second base assemblies is greater than a width of the first and second ladder frames; and a height of the first and second base assemblies is less than a width of the first and second walkboards so that the base assemblies fit inside the walkboards when the scaffold is disassembled.

2. The folding scaffold of claim 1, wherein the first base assembly comprises first and second foot members, and a lengthwise horizontal frame member connecting to and separating the first and second foot members.

3. The folding scaffold of claim 1, further comprising first and second ladder extensions removably connected to upper ends of the first and second ladder frames respectively, wherein:

the ladder extensions are movable between at least one extended position in the unfolded configuration and a retracted position in the folded configuration; and an overall length of the ladder frames and ladder extensions in the folded configuration is less than an overall length of the ladder frames and ladder extensions in any one of the extended positions.

4. The scaffold of claim 3, wherein each ladder extension comprises two vertical supports and at least one ladder rung connected between the vertical supports.

5. The scaffold of claim 4, further comprising a spreader bar configured to be connected between vertical supports of the first and second ladder extensions.

6. A folding scaffold movable between an unfolded configuration and a folded configuration, the folding scaffold comprising:

first and second ladder frames, each ladder frame comprising two vertical supports and a plurality of ladder rungs extending between the vertical supports, wherein one or more selected ladder rungs on each ladder frame include a crimped portion;

a hinge assembly interconnecting the first and second ladder frames, the hinge assembly comprising a hinge enabling movement of the scaffold between an unfolded configuration in which the ladder frames are spaced apart and a folded configuration in which the ladder frames are disposed side by side and the crimped portion of the selected ladder rungs on the first and second ladder frames define a clearance space between the ladder frames to receive the hinge in the folded configuration.

7. The scaffold of claim 6, wherein the crimped portion for each of the selected ladder rungs is offset from a longitudinal axis of the ladder rungs to create the clearance space between corresponding ladder rungs of the first and second ladder frames in the folded configuration.

8. The scaffold of claim 7, wherein the hinge assembly further comprises:

a pair of lower cross braces pivotally connecting the hinge to the first and second ladder frames respectively; and a pair of upper cross braces pivotally connecting the hinge to the first and second ladder frames respectively.

9. The scaffold of claim 8, wherein the lower cross braces connect to the respective ladder frames at a first connection point and the hinge at a second connection point, the first and second connection points being selected such that the lower cross members do not cross any of the ladder rungs of the first and second ladder frames in the folded configuration.

10. The scaffold of claim 9, wherein the upper cross braces connect to the respective ladder frames at a third connection point and to the hinge at a fourth connection point, the third and fourth connection points are selected such that the upper cross members do not cross any of the ladder rungs of the first and second ladder frames in the folded configuration.

11. The scaffold of claim 6, further comprising first and second ladder extensions configured to be movably connected to the first and second ladder frames respectively so as to be movable between retracted and extended positions.

12. The scaffold of claim 11, wherein each ladder extension comprises two vertical supports and at least one ladder rung connected between the vertical supports.

13. The scaffold of claim 12, further comprising a spreader bar configured to be connected between vertical supports of the first and second ladder extensions.

14. The scaffold of claim 6, wherein the scaffold further comprises first and second base assemblies configured to be removably connected to the first and second ladder frames, respectively.

15. The scaffold of claim 14, further comprising first and second walkboards configured to be removably supported between corresponding ladder rungs on the first and second ladder frames; wherein the first and second base assemblies are configured to fit inside the first and second walkboards respectively for storage.

16. The folding scaffold of claim 6, wherein the hinge assembly further includes a pair of first cross braces connecting the hinge to the first ladder frame, and a pair of second cross braces connecting the hinge to the second ladder frame.

17. The folding scaffold of claim 16, wherein a spacing between the hinge and the vertical supports of the first ladder frame, in the unfolded configuration, is less than a second spacing between the vertical supports of the first ladder frame.

18. The folding scaffold of claim 6, wherein the hinge is configured so as to be nested fully between the first and second ladder frames in the folded configuration.

* * * * *